US009243416B2

(12) United States Patent
Chism et al.

(10) Patent No.: US 9,243,416 B2
(45) Date of Patent: Jan. 26, 2016

(54) STORAGE TANK INSULATION JOINT APPARATUS AND METHOD

(71) Applicant: Pentair Thermal Management LLC, Menlo Park, CA (US)

(72) Inventors: Christopher Alan Chism, Houston, TX (US); Joe R. Rodriguez, Houston, TX (US)

(73) Assignee: Pentair Thermal Management LLC, Menlo Park, CA (US)

( * ) Notice: Subject to any disclaimer, the term of this patent is extended or adjusted under 35 U.S.C. 154(b) by 39 days.

(21) Appl. No.: 13/651,599

(22) Filed: Oct. 15, 2012

(65) Prior Publication Data

US 2013/0097951 A1 Apr. 25, 2013

Related U.S. Application Data

(60) Provisional application No. 61/549,956, filed on Oct. 21, 2011.

(51) Int. Cl.

| | |
|---|---|
| ***E04F 13/06*** | (2006.01) |
| ***E04H 7/06*** | (2006.01) |
| *E04F 13/08* | (2006.01) |
| *E04F 19/06* | (2006.01) |

(52) U.S. Cl.

CPC ..... *E04H 7/06* (2013.01); *E04H 7/065* (2013.01); *E04F 13/0864* (2013.01); *E04F 19/066* (2013.01)

(58) Field of Classification Search

CPC ..... E04B 1/684; E04B 1/66; E04B 1/38; E04B 2009/062; E04F 15/2005; E04F 19/066; E04F 13/0864; E04F 13/06

USPC ..... 52/245, 246, 247, 393, 395, 417, 459, 52/460, 461, 464, 465, 573.1; 220/592.09, 220/592.1

See application file for complete search history.

(56) References Cited

U.S. PATENT DOCUMENTS

| | | | | | |
|---|---|---|---|---|---|
| 2,150,399 | A | * | 3/1939 | Benedict | 52/447 |
| 2,158,234 | A | * | 5/1939 | Griebsch | 52/393 |
| 2,463,834 | A | * | 3/1949 | Von Breton | 52/245 |
| 2,651,447 | A | * | 9/1953 | Seaborne | 229/4.5 |
| 2,931,469 | A | * | 4/1960 | Sowles et al. | 52/246 |
| 3,320,707 | A | * | 5/1967 | Berg | 52/395 |
| 3,339,329 | A | * | 9/1967 | Berg | 52/395 |
| 3,353,316 | A | * | 11/1967 | Berg | 52/302.3 |
| 3,511,003 | A | * | 5/1970 | Alleaume | 52/198 |
| 3,621,635 | A | * | 11/1971 | Lange | 52/235 |
| 3,773,604 | A | | 11/1973 | Desai et al. | |

(Continued)

FOREIGN PATENT DOCUMENTS

| | | |
|---|---|---|
| FR | 2082402 | 3/1970 |
| GB | 2300664 | 11/1996 |

(Continued)

*Primary Examiner* — Phi A

(74) *Attorney, Agent, or Firm* — Quarles & Brady LLP

(57) ABSTRACT

A joint for fluid storage tank insulation systems. A central expansion joint forms a fluid-sealed recessed channel having a ridge-like cap. Water and moisture are directed away from the central expansion joint by the ridge-like cap. Any water that breaches the cap enters the recessed channel and flows out of the expansion joint without damaging tank insulation material. With installations having multiple expansion joints, at least one of the expansion joints can be equipped with an inverted cap to form a gutter within such expansion joint.

8 Claims, 4 Drawing Sheets

(56) References Cited

U.S. PATENT DOCUMENTS

| | | | | | |
|---|---|---|---|---|---|
| 3,775,921 | A | * | 12/1973 | Avera | 52/471 |
| 3,833,944 | A | * | 9/1974 | Goettl et al. | 52/169.7 |
| 3,971,075 | A | | 7/1976 | Heinbaugh et al. | |
| 4,015,384 | A | * | 4/1977 | Barry | 52/223.3 |
| 4,059,933 | A | * | 11/1977 | Funk et al. | 52/127.12 |
| 4,063,395 | A | * | 12/1977 | Stewart et al. | 52/309.5 |
| 4,071,994 | A | * | 2/1978 | Ammann | 52/393 |
| RE29,777 | E | * | 9/1978 | Crowley | 52/223.3 |
| 4,225,054 | A | * | 9/1980 | Jean | 220/592.2 |
| 4,408,426 | A | * | 10/1983 | Ystebo | 52/245 |
| 4,509,307 | A | * | 4/1985 | Beaudet | 52/309.4 |
| 4,533,278 | A | * | 8/1985 | Corsover et al. | 404/65 |
| 4,534,490 | A | | 8/1985 | McBride | |
| 4,781,004 | A | * | 11/1988 | Hartman | 52/464 |
| 5,020,294 | A | * | 6/1991 | Duda | 52/396.07 |
| 5,394,672 | A | * | 3/1995 | Seem | 52/794.1 |
| 5,743,063 | A | * | 4/1998 | Boozer | 52/713 |
| 6,012,259 | A | | 1/2000 | Hallsten | |
| 7,681,362 | B1 | * | 3/2010 | Averitt | 52/169.12 |
| 7,963,081 | B2 | * | 6/2011 | Pierson et al. | 52/461 |
| 8,127,512 | B2 | * | 3/2012 | Pierson et al. | 52/461 |
| 8,171,689 | B2 | * | 5/2012 | Pierson et al. | 52/461 |
| 2010/0083589 | A1 | * | 4/2010 | Crego | 52/60 |
| 2013/0180996 | A1 | * | 7/2013 | Lee et al. | 220/592.24 |

FOREIGN PATENT DOCUMENTS

| | | |
|---|---|---|
| WO | 89/08178 | 9/1989 |
| WO | 96/01348 | 1/1996 |

* cited by examiner

STORAGE TANK INSULATION JOINT APPARATUS AND METHOD

CROSS REFERENCES TO RELATED APPLICATION

Priority of U.S. Provisional Patent Application Ser. No. 61/549,956, filed Oct. 21, 2011, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to expansion joints for insulated fluid storage tanks. More particularly, the present invention pertains to expansion joints on thermally insulated fluid storage tanks. More particularly still, the present invention pertains to a expansion joints on fluid storage tanks, including upper surfaces of said fluid storage tanks, and a method for installing such expansion joints.

2. Brief Description of the Prior Art

The installation and use of thermal insulation on storage tanks is well known. Such thermal insulation can be particularly beneficial on large, flat-bottomed tanks used for storing materials that are sensitive to temperature fluctuations. Among other benefits, the insulation acts to reduce heat loss or gain of the materials stored within such tanks.

Existing methods for insulating storage tanks frequently employ interlocking panels of insulation and jacketing material. In one common method of insulating fluid storage tanks, a first layer of insulation panels is installed on the outer surfaces of a storage tank. Thereafter, a second layer of jacketing material is installed around the insulation material, encasing the insulation panels and securing such insulation panels in place around such storage tank.

Such insulation and jacket panels, typically fabricated to fit the specific dimensions of a particular storage tank, can frequently include flanges that are mechanically connected to adjacent panels. In one common prior art method, mechanical seams are used to join adjacent panels and create a homogeneous outer jacket that secures insulation panels to a storage tank. Ideally, such panels prevent moisture ingress, provide wind resistance and thermal insulation, and have inherent expansion and contraction properties to account for thermal expansion and contraction effects.

Depending on the operating temperature of a tank, as well as the ambient temperatures in the environment surrounding such tank, tank insulation systems may require installation of at least one expansion/contraction joint ("expansion joint"), especially on the roof or upper surface(s) of such tank. Such expansion joints absorb thermal expansion or contraction of the storage tank itself, as well as expansion and contraction of insulation materials and metal jacketing or cladding around such tank.

Such expansion joints are especially useful when installed on roofs or upper surface(s) of storage tanks because such areas can be particularly susceptible to thermal expansion and contraction. However, existing expansion joints are typically prone to water intrusion, as rain water and/or moisture from other sources have a tendency to collect on the upper surfaces of storage tanks.

In most cases, roofs and other upper surface(s) of storage tanks are manufactured using a number of steel sheets or other components that are welded or otherwise jointed together to form a substantially continuous surface. Although such steel sheets or other manufacturing components are generally rigid, and typically have at least a gentle slope from the center toward the outer edges of a roof to facilitate water drainage, low spots or depressions can nonetheless form at different places, particularly along the relatively large surface area of a tank roof; rain water and moisture from other sources can frequently collect and pond in such low spots. If an expansion joint happens to intersect or be in close proximity to such a low spot, water or moisture that collects at such a low spot can enter the expansion joint. Even without such low spots, driven rain and other precipitation can often directly invade conventional expansion joints.

Water or moisture entering a conventional expansion joint can often intrude into the space formed between the outer surface of a storage tank and the inner surface of the insulation materials (typically panels) covering said tank. Such water or moisture frequently results in oxidation or corrosion of the storage tank. In many cases, water in this space can also flow outward off the upper surface of a tank, over the outer perimeter edge of the tank roof, and collect behind vertical insulation panels disposed around the side walls of said tank. If enough water collects behind such insulation panels, the weight of such water can cause a catastrophic failure of the insulation system and its means of attachment to an underlying storage tank.

In an attempt to direct water away from expansion joints, prior art methods have included the construction of raised dam-like features near such expansion joints. In many cases, such dam-like features are formed by turning up panel ends near the expansion joint. Ideally, any water collecting near an expansion joint will be prevented from entering such expansion joint by the raised dam-like members and, as a result, pond away from the expansion joint and eventually run off or evaporate from the tank roof. Additionally, elongate cap members (typically constructed of metal) are fabricated and installed over expansion joints. However, such efforts have proven to be ineffective at keeping water and moisture out of expansion joints, especially with respect to wind-driven precipitation or moisture.

Thus, there is a need for an improved expansion joint that beneficially prevents water (in the form of rain, precipitation or otherwise) and moisture from entering such expansion joint and contacting insulation materials in proximity to said expansion joint. Said expansion joint should prevent water and moisture from intruding into the spaces formed between insulation panels and the outer surface of a storage tank, as well as spaces existing between insulation and jacketing materials.

SUMMARY OF THE PRESENT INVENTION

The expansion joint of the present invention provides a solution for keeping liquids (water and/or moisture) entering such expansion joint isolated from insulation materials, as well as underlying storage tank surfaces. Unlike prior art expansion joints that merely attempt to prevent water from entering said expansion joints, the expansion joint of the present invention comprises a channel that acts to collect any water and moisture entering said expansion joint, and direct said water and moisture away from said expansion joint.

In the preferred embodiment, the expansion joint of the present invention comprises a channel, fluid sealed with at least one flexible impermeable material (such as, for example, Thermoplastic Elastomer or "TPE"). Said expansion joint of the present invention can also be beneficially covered by a metal expansion/contraction cap. Said channel is recessed relative to the surrounding insulation panels in order to allow any water that breaches the cap and enters the channel to flow within such channel, over the tank sidewalls and to away from said roof or upper surface.

The installation of a central expansion joint of the present invention can generally comprise the following basic steps:

Roof insulation panels (typically standing seam panels) are installed on the upper surface of a tank roof. Opposing ends of said roof insulation panels are spaced a desired distance apart, thereby forming a substantially elongate gap between such panels. In the preferred embodiment, said gap extends substantially along the entire width of said tank roof, and passes through the center point of said tank roof. Once said gap is formed, filler insulation material is then installed in such gap. Said filler insulation material has a thickness that is less than the thickness of surrounding roof insulation panels, thereby forming a recessed channel within said gap. Said recessed channel extends substantially along the width of said tank roof.

An elongate strip of flexible and impermeable material such as TPE, ideally having reinforced edges, is installed within said recessed channel along the length of said expansion joint. In the preferred embodiment, such reinforced edges comprise parallel concertina or accordion-like aluminum members molded within said strip along both long sides of said TPE strip. The outer metal jacketing or cladding material is then installed, such that said reinforced edges of said TPE strip are beneficially inserted or sandwiched between the insulation material and outer metal jacketing. Although said strip member is described herein as being constructed of TPE material, it is to be observed that other flexible and relatively impermeable materials can likewise be used for this purpose.

Butyl tape is then installed on the bottom of a pre-manufactured elongate metal expansion/contraction cap, and said cap is placed over the expansion/contraction joint (that is, said elongate recessed channel), notching out where required for individual seams. Fasteners (which can include, without limitation, pop rivets or the like) are installed along a desired spacing pattern to penetrate the metal cap, butyl tape, metal roof panel and reinforced edges of said TPE strip.

Although the above process can be employed at virtually any position along the roof or other upper surface of a storage tank, it is particularly useful when utilized to install an expansion joint centrally positioned on said roof or other upper surface of such tank. Additionally, an alternative embodiment outer expansion joint utilizes the same basic design as a "central" expansion joint described above, except that the outer expansion/contraction metal cap member is essentially inverted and installed as a gutter to allow any roof water to run to the outside of the tank roof. In such alternative embodiment, edges or flanges of said metal cap member can be beneficially installed under center roof panels, and over the outer roof panels, to provide positive water shed characteristics. Because a TPE strip is installed under said inverted metal cap member, it serves as flashing to channel any water or moisture that might enter through the insulation system around the metal cap to the outside of the tank roof.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 1:
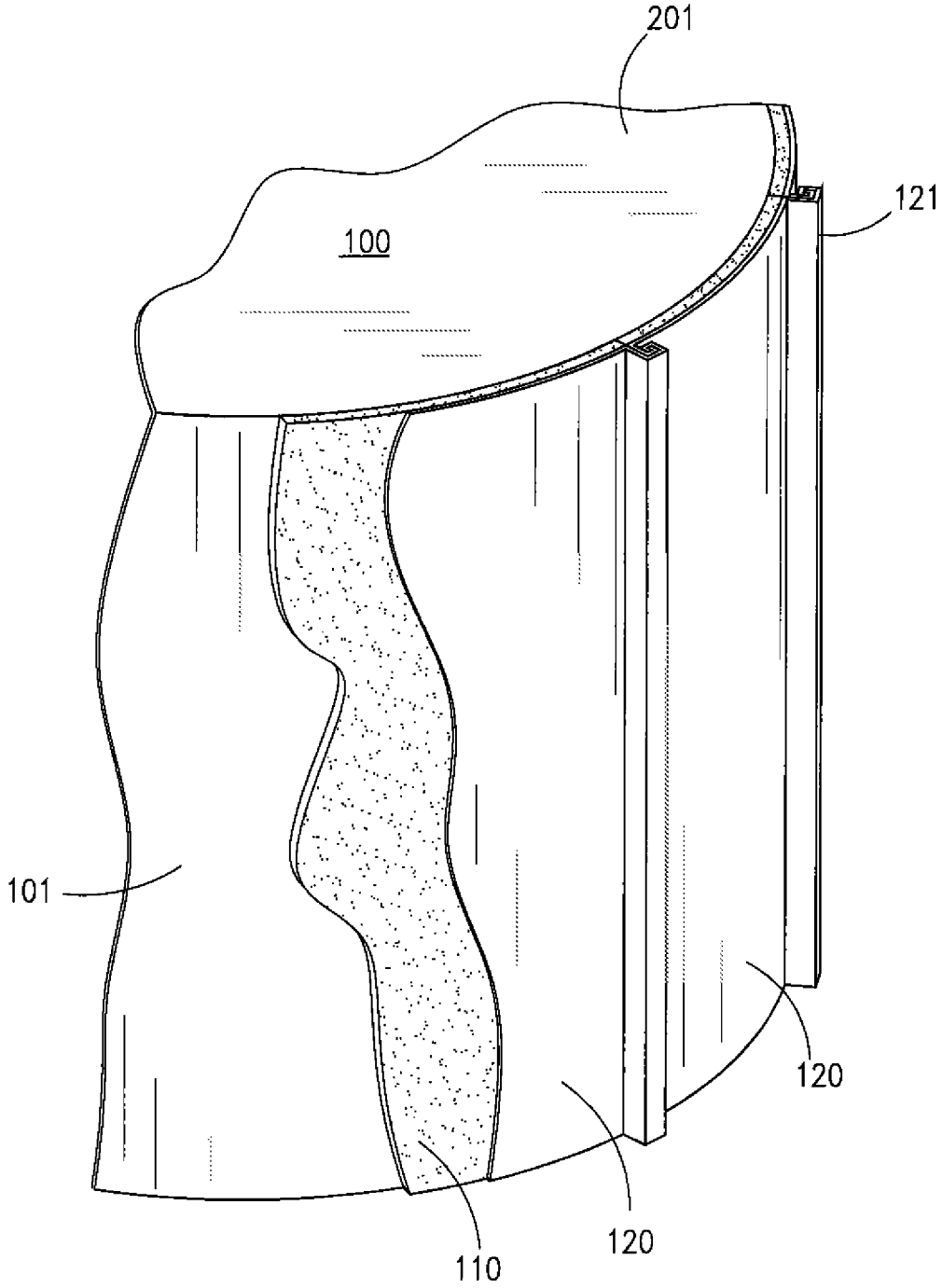
FIG. 1 depicts a side perspective and partial sectional view of an insulated fluid storage tank.

Referring to the drawings, FIG. 1 depicts a side perspective and partial sectional view of an externally insulated fluid storage tank 100. As depicted in FIG. 1, said storage tank 100 is substantially cylindrical, and has a substantially flat roof or upper surface. As depicted in FIG. 1, said storage tank 100 comprises substantially vertical side wall 101 and substantially horizontal roof section 201. By way of illustration, but not limitation, said tank side wall 101 can be constructed of steel or other suitable rigid material having desired strength and other characteristics.

As depicted in FIG. 1, storage tank 100 includes an external insulation system. Said external insulation system generally comprises interlocking prefabricated insulation panels 110 and jacketing material 120. A first layer of insulation panels 110 having desired thermal insulation and other characteristics is installed around the outer surfaces of storage tank 100. Thereafter, a second layer of jacketing material 120 is installed around said insulation panels 110, encasing the insulation panels 110 and securing such insulation panels in place around storage tank 100.

In the embodiment depicted in FIG. 1, mechanical seams 121 are used to join vertical jacket panels 120 and create a homogeneous outer jacket that secures insulation panels 110 to storage tank 100. Ideally, such jacket panels 120 prevent water/moisture ingress, provide wind resistance, and have inherent expansion and contraction properties.

Figure 4:
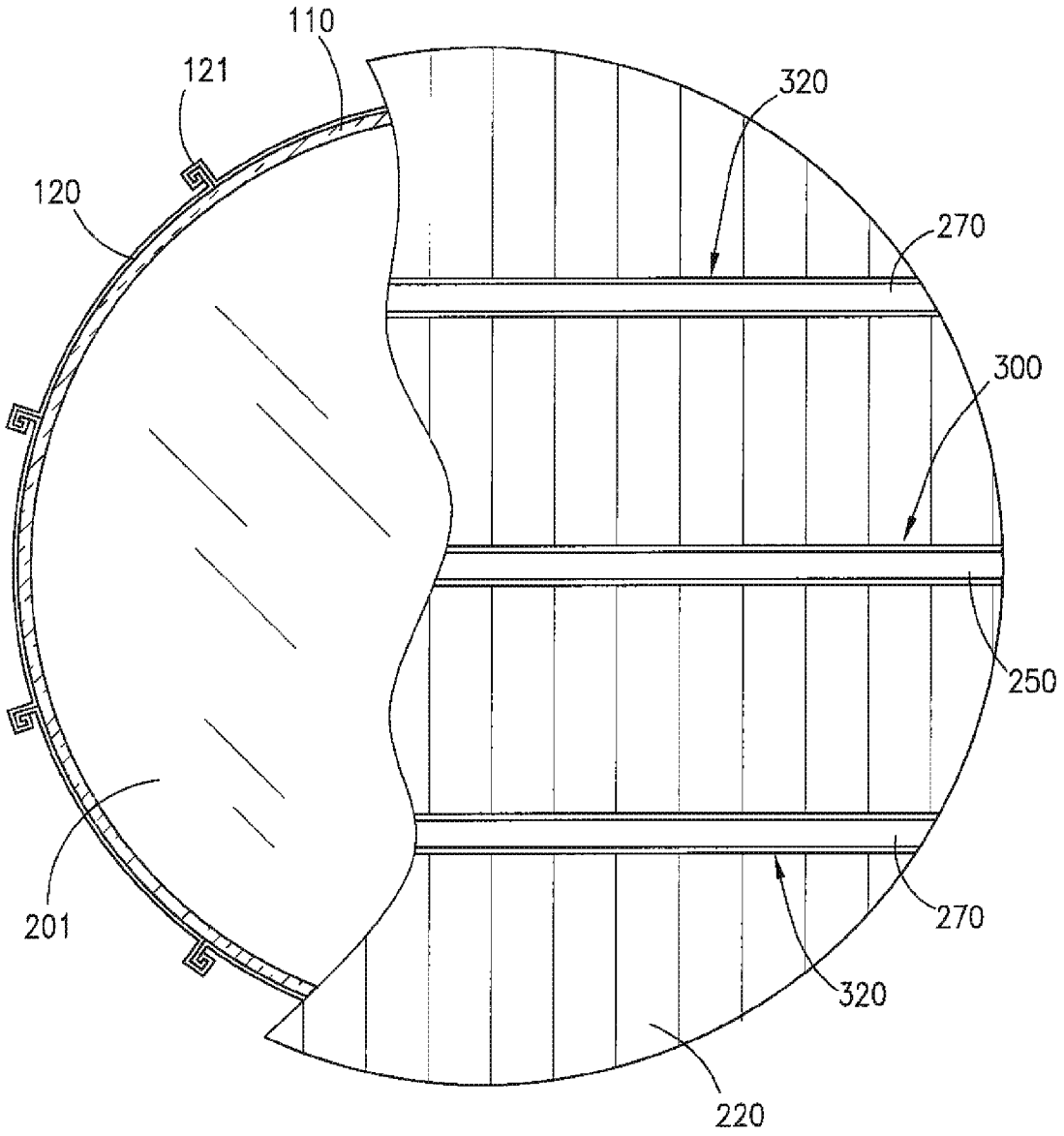
FIG. 4 depicts an overhead view of a fluid storage tank equipped with the center and outer expansion joints of the present invention.

Referring briefly to FIG. 4, which depicts an overhead view of fluid storage tank 100, said fluid storage tank 100 is equipped with an external insulation system generally comprising a first layer of substantially vertical insulation panels 110 and a second, outer layer of substantially vertical metal panels 120. Said fluid storage tank 100 is further equipped with a similar layer of insulation materials and metal jacketing panels disposed on upper surface of roof 201 as more fully described herein.

Figure 2:
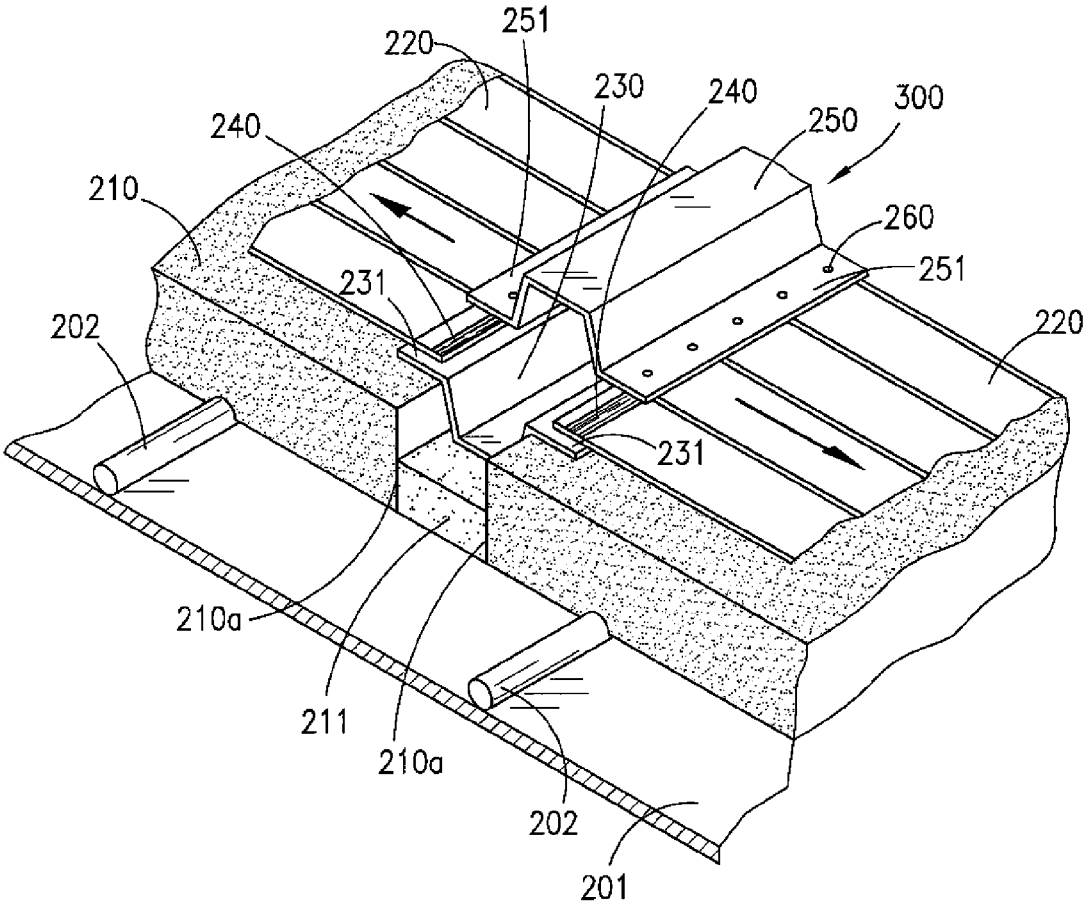
FIG. 2 depicts a side sectional view of a "center" expansion joint of the present invention.

FIG. 2 depicts a side sectional view of a "central" expansion joint 300 of the present invention. Although said joint 300 (as well as outer expansion joint 320 described below) is referred to herein as an "expansion" joint for ease of reference, it is to be observed that said joint 300 is also capable of accommodating contraction forces. Standing seam roof insulation panels 210 having a desired thickness are installed on the upper surface of a tank roof 201 with ends 210*a* spaced a desired distance apart to form an elongate gap at the desired location of expansion/contraction joint. Optional securement roof rods 202 can also be installed.

A section of insulation panel 211 is disposed in the gap formed between opposing ends 210*a* of roof insulation panels 210. In the preferred embodiment, insulation 211 has a thickness less than the thickness of roof insulation panels 210, thereby forming an elongate recessed channel. In the preferred embodiment, insulation panel 211 has approximately one half of the thickness of adjacent insulation panels 210.

In a preferred embodiment, elongate TPE (Thermoplastic Elastomer) strip 230 having parallel reinforced side edge sections 231 is installed so that a central portion of said strip 230 is received on panel 211 within said recessed channel formed between opposing insulation panel members 210. The longitudinal axis of said elongate TPE strip 230 is substantially the same as the longitudinal axis of said recessed groove formed between opposing insulation panels 210. As depicted in FIG. 2, said reinforced side edge sections 231 further comprise concertina shaped aluminum strip(s) molded within or securely attached to said TPE strip 230, extending substantially along the entire length of said TPE strip 230.

Reinforced side edge sections 231 of said strip 230 extend out of said recessed channel and lay on the upper surfaces of insulation panels 210 on both sides of said recessed channel, along substantially the entire length of said recessed channel. Metal roof jacket panels 220 are installed on the upper surfaces of said upper insulation panels 210, such that reinforced edge sections 231 of elongate TPE strip 230 are beneficially received or sandwiched between insulation panels 210 and a portion of outer metal jacket panels 220.

Butyl tape 240 is installed on the upper surface of said metal jacket panels 220, or the bottom of flange members 252 of elongate expansion cap 250. Thereafter, said cap 250 is installed the expansion joint of the present, notching out where necessary for individual seams of outer metal jacket panels 220. In the preferred embodiment, elongate cap 250 has a substantially U-shaped or trapezoidal-shaped profile, extending higher than the surrounding insulation panels and jacketing panels, and allowing for expansion or contraction in a direction substantially perpendicular to the longitudinal axis of said elongate expansion cap 250. Fasteners 260 (such as, for example pop rivets or threaded bolts) are installed along a desired spacing pattern to penetrate flange members 251 of cap 250, butyl tape 240, metal roof panel 220, and reinforced edge sections 231 of TPE strip 230. In the preferred embodiment, expansion cap 250 extends higher than the upper surfaces of metal roof jacket panels 220, thereby serving as a dam-like feature to direct liquids away from said expansion joint.

A watertight central expansion joint 300 as depicted in FIG. 2 can extend from side to side across the roof of a storage tank, typically passing through the center point of said tank. In many instances, this path will be across the crest of said tank roof, such that said expansion joint will be sloped downward from said center point toward the outer edges (sides) of said tank. As such, water entering said expansion joint drains away from the center of said roof, and toward the outer edges of said tank roof. Water not entering said expansion joint 300 generally drains away from said expansion joint 300 in the direction of the arrows depicted in FIG. 2.

Figure 3:
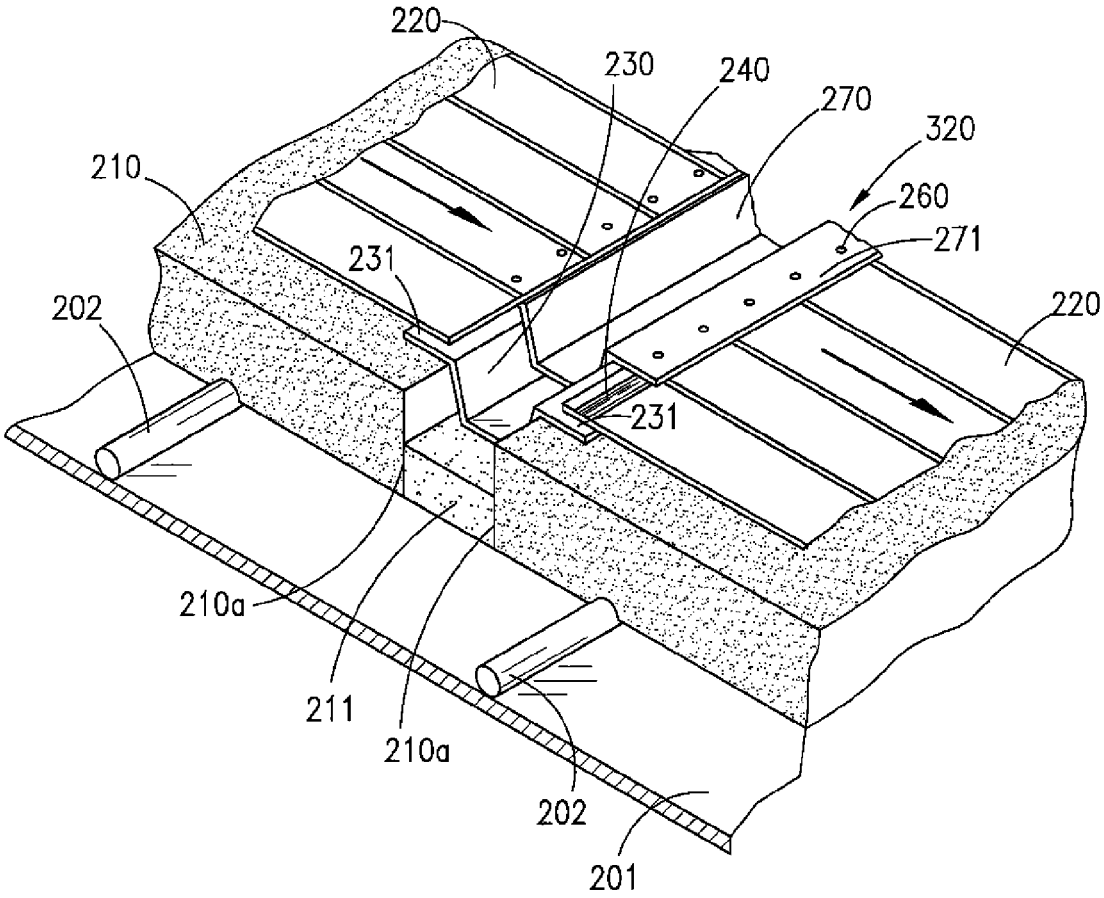
FIG. 3 depicts a side sectional view of an alternative embodiment "outer" expansion joint of the present invention.

FIG. 3 depicts a side sectional view of an alternative embodiment "outer" expansion joint 320 of the present invention. Said "outer" expansion joint 320 is installed in essentially the same manner as the central expansion joint 300 described above. Namely, a section of insulation panel 211 is disposed in the gap formed between opposing ends 210*a* of roof insulation panels 210. As with a central expansion joint, insulation 211 has a thickness less than the thickness of roof insulation panels 210, thereby forming an elongate recessed channel. In the preferred embodiment, insulation panel 211 has approximately one half of the thickness of adjacent insulation panels 210.

A flexible, impermeable strip is disposed within said recessed channel. In the preferred embodiment, an elongate TPE (Thermoplastic Elastomer) strip 230 having parallel reinforced side edge sections 231 is installed so that a central portion of said strip 230 is received on panel 211 within said recessed channel formed between opposing insulation panel members 210. Said reinforced side edge sections 231 further comprise concertina shaped aluminum strip(s) molded within or securely attached to said TPE strip 230, extending substantially along the entire length of said TPE strip 230.

Reinforced side edge sections 231 of said strip 230 extend out of said recessed channel and lay on the upper surfaces of insulation panels 210 on both sides of said recessed channel, along substantially the entire length of said recessed channel. Metal roof jacket panels 220 are installed on the upper surfaces of said upper insulation panels 210, such that reinforced edge sections 231 of elongate TPE strip 230 are beneficially received or sandwiched between insulation panels 210 and a portion of outer metal jacket panels 220.

Butyl tape 240 is installed on the upper surface of said metal jacket panels 220. Thereafter, said cap 270 is installed over the expansion/contraction joint, notching out where necessary for individual seams. Unlike cap 250 depicted in FIG. 2, which forms an upwardly-extending ridge or dam-like feature, cap 270 is substantially concave in shape. As such, said cap 270 acts to form a gutter that extends across substantially the entire width of a tank roof.

In the alternative embodiment depicted in FIG. 3, said expansion joint 320 is typically installed on a sloped portion of a tank roof, with said slope and water draining generally in the direction of the arrows depicted in FIG. 3. Accordingly, flat edges or flanges 271 of said metal cap member 270 can be beneficially installed ("tucked") under the edges of roof panels 220 on the higher side of the tank roof, and over the edges of roof panels 220 on the lower side of the tank roof, to provide positive water shed characteristics. Because TPE strip 230 is installed under said inverted metal cap 270, such TPE strip 230 serves as flashing to channel any water or moisture that might enter through the insulation system around the metal cap to the outside of the tank roof. Fasteners 260 (such as, for example pop rivets) are installed along a desired spacing pattern to penetrate flanges 271 of cap 270, butyl tape 240, metal roof panel 220, and aluminum edge 231 of elongate TPE strip 230.

FIG. 4 depicts an overhead view of a fluid storage tank equipped with a central expansion joint 300 and outer expansion joints 320 of the present invention, providing a system to accommodate tank roof expansion and contraction. Metal cap 250 forms a ridge that acts to direct water outward from a central expansion joint—that is, toward the outer rim of a tank and away from said central expansion joint. However, in the event that any water should breach said cap 250 and enter said central expansion joint, the water enters an impermeable gutter (lined with TPE strip 230) that carries such water out of the expansion joint and toward the edges of the tank roof where it can harmlessly drain off of said tank roof. Water on the tank roof that is directed away from said central expansion joint by cap 250 can enter channels formed by inverted metal caps 270 at outer expansion joints. Such water flows within said outer channels to the outside of the tank roof where it also harmlessly drains off of the tank roof.

The present invention is described herein primarily for use as a means to account for thermal expansion/contraction of insulation materials on fluid storage tank roofs. However, it is to be observed that the present invention can also be used as a joint between insulation members, even when such expansion/contraction is not encountered or is not a significant concern. For example, the joint of the present invention can be used as a beneficial means for splicing insulation materials on a tank roof or other surface.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A joint between adjacent insulation panels on an upper surface of a fluid storage tank comprising:

a recessed channel formed between the insulation panels;

jacketing material disposed on the insulation panels along the recessed channel;

a thermoplastic elastomer strip disposed within the channel along substantially the entire length of the channel, wherein at least one side of the thermoplastic elastomer strip extends out of the channel and is secured to the jacketing material; and an elongate cap disposed over substantially the entire length of the elongate channel wherein the cap extends higher than the jacketing material.

2. The joint of claim 1, further comprising butyl tape disposed between the elongate cap and the jacketing material.

3. The joint of claim 1, wherein the elongate strip has at least one integrally molded reinforced edge.

4. The joint according to claim 1, wherein the recessed channel slopes toward at least one side of the fluid storage tank.

5. The joint according to claim 1, wherein the joint is adapted to contract in a direction substantially perpendicular to the longitudinal axis of the elongate channel.

6. The joint according to claim 1, wherein the joint is adapted to expand in a direction substantially perpendicular to the longitudinal axis of the elongate channel.

7. A method for forming a joint between adjacent insulation panels on an upper surface of a fluid storage tank, the method comprising:

forming an elongate recessed channel between the adjacent insulation panels;

installing jacketing material on the insulation panels proximate to the recessed channel;

installing a thermoplastic elastomer strip having at least one long side within the channel along substantially the entire length of the channel, wherein the at least one long side of the thermoplastic elastomer strip extends out of the channel;

securing the thermoplastic elastomer strip to the jacketing material along at least one side of the recessed channel; and installing an elongate cap over substantially the entire length of the recessed channel wherein the cap extends higher than the jacketing material.

8. The method of claim 7, further comprising disposing butyl tape between the elongate cap and the jacketing material.

* * * * *